US008653906B2

(12) United States Patent
Mahon et al.

(10) Patent No.: US 8,653,906 B2
(45) Date of Patent: Feb. 18, 2014

(54) OPPOSED PORT ORTHO-MODE TRANSDUCER WITH RIDGED BRANCH WAVEGUIDE

(75) Inventors: John P. Mahon, Thousand Oaks, CA (US); Cynthia P. Espino, Carlsbad, CA (US)

(73) Assignee: Optim Microwave, Inc., Camarillo, CA (US)

( * ) Notice: Subject to any disclaimer, the term of this patent is extended or adjusted under 35 U.S.C. 154(b) by 324 days.

(21) Appl. No.: 13/150,551

(22) Filed: Jun. 1, 2011

(65) Prior Publication Data

US 2012/0306592 A1 Dec. 6, 2012

(51) Int. Cl.
*H01P 1/161* (2006.01)
*H01P 5/12* (2006.01)

(52) U.S. Cl.
USPC ..... 333/137; 333/21 A; 333/122; 333/135

(58) Field of Classification Search
USPC ..... 333/21 A, 21 R, 122, 125, 137, 135
See application file for complete search history.

(56) References Cited

U.S. PATENT DOCUMENTS

| | | | |
|---|---|---|---|
| 2,716,221 | A | 8/1955 | Allen |
| 2,783,439 | A | 2/1957 | Whitehorn |
| 3,164,789 | A | 1/1965 | Grosbois et al. |
| 3,201,717 | A | 8/1965 | Grosbois et al. |
| 3,758,882 | A | 9/1973 | Morz |
| 3,932,822 | A | 1/1976 | Salzberg |
| 4,523,160 | A | 6/1985 | Ploussios |
| 4,613,836 | A | 9/1986 | Evans |
| 4,725,795 | A | 2/1988 | Ajioka et al. |
| 4,806,945 | A | 2/1989 | Cormier et al. |
| 4,849,720 | A | 7/1989 | Call |
| 4,951,010 | A | 8/1990 | Grim |
| 4,982,171 | A | 1/1991 | Figlia et al. |
| 5,376,905 | A | 12/1994 | Kich |
| 5,392,008 | A | 2/1995 | Wong |
| 6,087,908 | A | 7/2000 | Haller et al. |
| 6,166,610 | A | 12/2000 | Ramanujam et al. |
| 6,225,875 | B1 | 5/2001 | Kich |
| 6,297,710 | B1 | 10/2001 | Cook et al. |
| 6,417,742 | B1 | 7/2002 | Enokuma |
| 6,496,084 | B1 | 12/2002 | Monte et al. |

(Continued)

OTHER PUBLICATIONS

Rong et al . Characteritics of Generalized Rectangular and Ciruclar Ridge Waveguide, Feb. 200, IEEE Transactuins on Microwave Theory and Technigues, vol. 48, No. 2, pp. 258-265.*

(Continued)

*Primary Examiner* — Robert Pascal
*Assistant Examiner* — Kimberly Glenn
(74) *Attorney, Agent, or Firm* — SoCal IP Law Group LLP; John E. Gunther; Mark A. Goldstein

(57) ABSTRACT

An ortho-mode transducer may include a common waveguide terminating in a common port. A horizontal branch waveguide may terminate in a horizontal port. The horizontal branch waveguide may couple a first linearly polarized mode from the horizontal port to the common waveguide. The horizontal branch waveguide may comprise one or more ridged waveguide segments. A vertical branch waveguide may terminate in a vertical port opposed to the horizontal port. The vertical branch waveguide may couple a second linearly polarized mode from the vertical port to the common waveguide, the second linearly polarized mode orthogonal to the first linearly polarized mode.

19 Claims, 8 Drawing Sheets

(56) References Cited

U.S. PATENT DOCUMENTS

| | | | |
|---|---|---|---|
| 6,677,911 | B2 | 1/2004 | Moheb |
| 6,842,085 | B2 | 1/2005 | Chen et al. |
| 6,904,394 | B2 | 6/2005 | Jaffrey |
| 7,019,603 | B2 | 3/2006 | Yoneda et al. |
| 7,236,681 | B2 | 6/2007 | Moheb et al. |
| 7,330,088 | B2 | 2/2008 | Aramaki et al. |
| 7,656,246 | B2 | 2/2010 | Mahon et al. |
| 7,772,940 | B2 | 8/2010 | Mahon et al. |
| 2004/0032305 | A1 | 2/2004 | Bohnet |
| 2004/0160292 | A1 | 8/2004 | Chen et al. |
| 2007/0210882 | A1 | 9/2007 | Mahon et al. |

OTHER PUBLICATIONS

Eric S. Key, General Cylinder (C), Dec. 30, 1999, article, https://pantherfile.uwm.edu/ericskey/www/TANOTES/Geomentry/node19.html9/30/2010, accessed on Sep. 30, 2010.

Perov, A.O., et al., Orthomode Transducers with a Common Circular Waveguide, Journal of Communications Technology and Electronics, 2007, vol. 52, No. 6, pp. 626-632.

Anton M. Boifot, Classification of Ortho-Mode Transducers, European Transactions on Telecommunications, Sep. 1991, vol. 2, No. 5, pp. 503-510.

* cited by examiner

Section D-D

Section C-C

Section B-B

OPPOSED PORT ORTHO-MODE TRANSDUCER WITH RIDGED BRANCH WAVEGUIDE

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to waveguide devices used to combine or separate two orthogonal modes, also known as ortho-mode transducers (OMTs).

2. Description of the Related Art

Satellite broadcasting and communications systems may use a first signal having a first polarization state for the uplink to the satellite and a second signal having a second polarization state, orthogonal to the first polarization state, for the downlink from the satellite. Note that two circularly polarized signals are orthogonal if the e-field vectors rotate in the opposite directions. The polarization directions for the uplink and downlink signals may be determined by the antenna and feed network on the satellite.

A common form of antenna for transmitting and receiving signals from satellites consists of a parabolic dish reflector and a feed network where orthogonally polarized modes travel in a common waveguide. The common waveguide may typically be cylindrical or square, but may be elliptical or rectangular. In this patent, the term "cylindrical waveguide" means a waveguide segment shaped as a right circular cylinder, which is to say the cross-sectional shape of the waveguide segment is circular. Similarly, the terms "elliptical waveguide", "rectangular waveguide", and "square waveguide" mean a waveguide segment having an elliptical, rectangular, or square cross-sectional shape, respectively. An ortho-mode transducer may be used to launch or extract the orthogonal linearly polarized modes into or from the cylindrical waveguide.

An ortho-mode transducer (OMT) is a three-port waveguide device having a common waveguide coupled to two branching waveguides. Within this description, the term "port" refers generally to an interface between devices or between a device and free space. A port of a waveguide device may be formed by an aperture in an interfacial surface to allow microwave radiation to enter or exit a waveguide within the device.

The common waveguide of an OMT typically supports two orthogonal linearly polarized modes. Within this document, the terms "support" and "supporting" mean that a waveguide will allow propagation of a mode with little or no loss. In a feed system for a satellite antenna, the common waveguide may be a cylindrical waveguide. The two orthogonal linearly polarized modes may be $TE_{11}$ modes which have an electric field component orthogonal to the axis of the common waveguide. When the cylindrical waveguide is partially filled with a dielectric material, the two orthogonal linearly polarized modes may be hybrid $HE_{11}$ modes which have at least some electric field component along the propagation axis. Two precisely orthogonal $TE_{11}$ or $HE_{11}$ modes do not interact or cross-couple, and can therefore be used to communicate different information.

The common waveguide terminates at a common port, which is to say that a common port aperture is defined by the intersection of the common waveguide and an exterior surface of the OMT.

Each of the two branching waveguides of an OMT typically supports only a single linearly polarized $TE_{10}$ mode. The mode supported by the first branching waveguide is orthogonal to the mode supported by the second branching waveguide. Within this document, the term "orthogonal" will be used to describe the polarization direction of modes, and "normal" will be used to describe geometrically perpendicular structures.

A traditional OMT, for example as shown in U.S. Pat. No. 6,087,908, has one branch waveguide axially aligned with the common waveguide, and one branch waveguide normal to the common waveguide. The branch waveguide that is axially aligned with the common waveguide terminates at what is commonly called the vertical port. The linearly polarized mode supported by the vertical port is commonly called the vertical mode. The branch waveguide which is normal to the common waveguide is terminated at what is commonly called the horizontal port. The branch waveguide that terminates at the horizontal port also supports only a single polarized mode commonly called the horizontal mode.

The terms "horizontal" and "vertical" will be used in this document to denote the two orthogonal modes and the waveguides and ports supporting those modes. Note, however, that these terms do not connote any particular orientation of the modes or waveguides with respect to the physical horizontal and vertical directions.

DESCRIPTION OF THE DRAWINGS

Elements in the drawings are assigned reference numbers which remain constant among the figures. An element not described in conjunction with a figure may be presumed to be the same as a previously-described element having the same reference number.

DETAILED DESCRIPTION

Description of Apparatus

Figure 1:
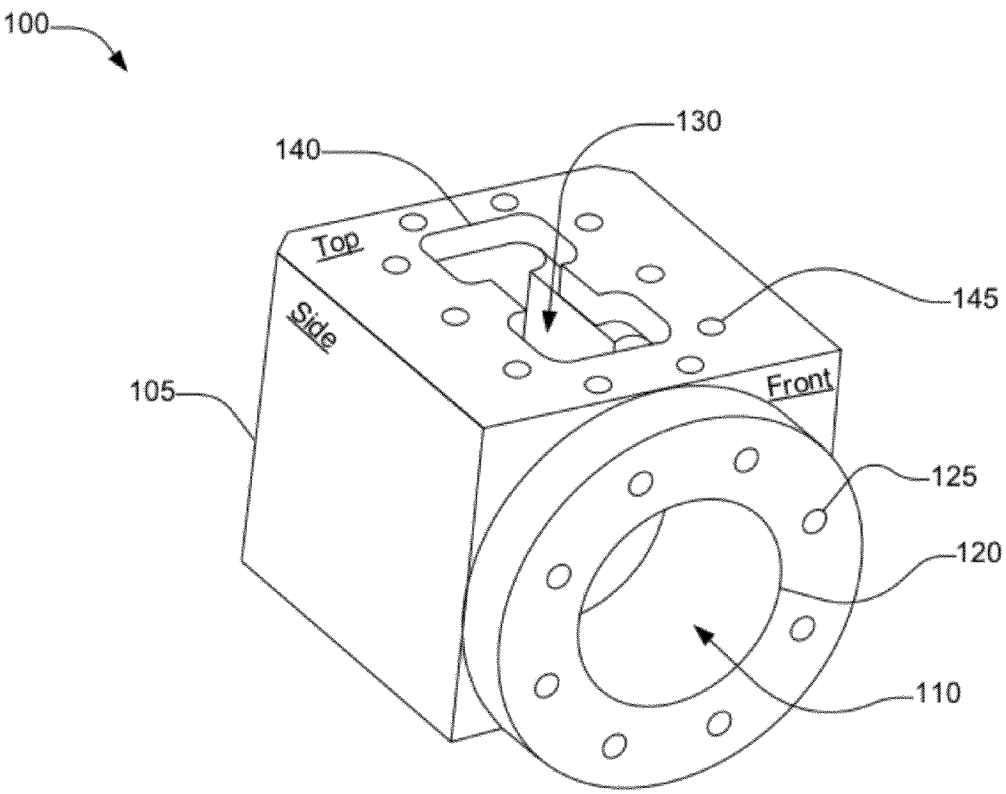
FIG. 1 is a perspective view of an OMT having a ridged branch waveguide.

FIG. 1 is a perspective view showing the top, front, and side of an exemplary ortho-mode transducer (OMT) 100. The terms "top", "front", and "side" refer to the OMT as shown in FIG. 1 and do not imply any absolute orientation of the OMT. The OMT 100 may be formed as a series of machined cavities within an OMT body 105. The OMT body 105 may be a conductive metal material such as aluminum, or a nonconductive material such as plastic with a conductive coating deposited on at least the interior surfaces of the OMT body 105. The OMT 100 may include a common waveguide 110 that terminates at a common port 120. In this example, the common waveguide 110 is a cylindrical waveguide. The common waveguide of an OMT may be cylindrical, elliptical, square, rectangular, or some other shape. The OMT 100 may include a horizontal branch waveguide 130 that terminates at a horizontal port 140. The horizontal branch waveguide 130 may be configured to support a first $TE_{11}$ mode and to couple the first $TE_{11}$ mode into or from the cylindrical common waveguide 110. Threaded holes 125, 145 may be provided adjacent to the common port 120 and the horizontal port 140 to facilitate coupling a waveguide or other component (not shown) to the ports.

The OMT 100 may include a vertical port and a vertical branch waveguide not visible in FIG. 1. The vertical branch waveguide may be configured to support a second $TE_{11}$ mode and to couple the second $TE_{11}$ mode into or from the cylindrical common waveguide 110. A polarization direction of the second $TE_{11}$ mode may be orthogonal to a polarization direction of the first $TE_{11}$ mode. The terms "vertical" and "horizontal" do not imply any absolute orientation of the OMT 100.

The vertical port may be opposed to the horizontal port 140, which is to say that the vertical port and the horizontal port may be disposed on parallel surfaces facing in opposite directions. The vertical port may be disposed on a bottom surface (not visible) of the OMT 100 that faces downward as in FIG. 1. In an OMT having opposed branch ports, both branch waveguides may be normal to the common waveguide. An OMT having opposed branch ports may allow a shorter, more compact antenna feed network than a traditional OMT having one branch waveguide axially aligned with the common waveguide.

Figure 2:
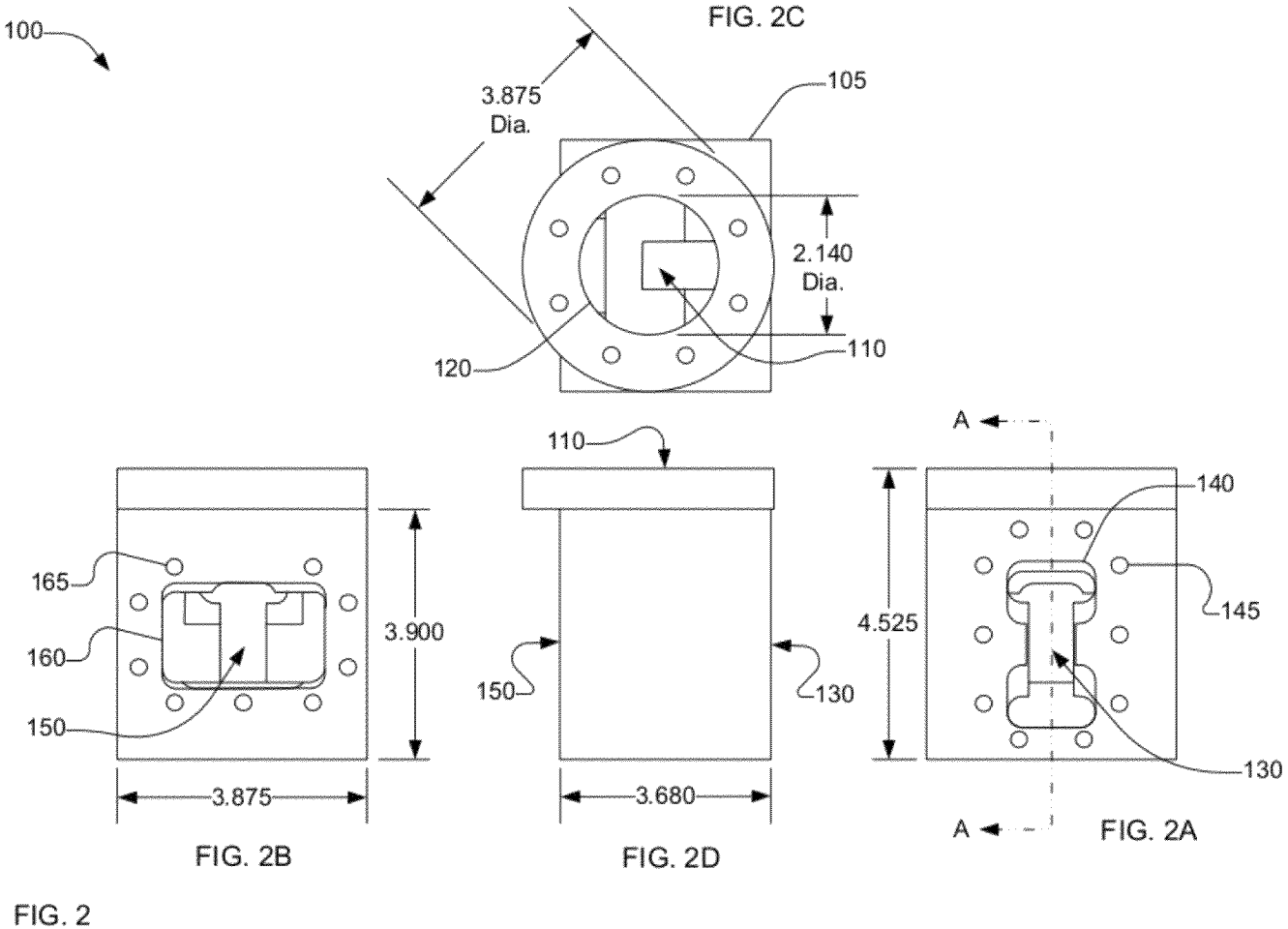
FIG. 2 is a mechanical drawing including four views of an OMT. For ease of discussion, the four views are labeled FIG. 2A, FIG. 2B, FIG. 2C, and FIG. 2D.

FIG. 2 is a mechanical drawing including four views of the OMT 100. For ease of discussion, the four views are labeled FIG. 2A, FIG. 2B, FIG. 2C, and FIG. 2D. Dimensions provided in the views are for a C-band OMT designed for operation over a frequency band of 3.625 GHz to 4.2 GHz. These dimensions are exemplary. The OMT 100 may be scaled for operation in other frequency bands.

FIG. 2A is a top view of the OMT 100 normal to the surface of the OMT containing the horizontal port 140. Some of the interior structure of the OMT 100 is visible through the horizontal branch waveguide 130. The interior structure will be described in greater detail subsequently. The threaded holes 145 may be configured to allow other components using a standard waveguide flange to be coupled to the horizontal port 140. For example, in the case of the exemplary C-band OMT, the threaded holes 145 may be compatible with a standard WR-229 waveguide flange.

FIG. 2B is a bottom view of the OMT 100 normal to the surface of the OMT containing a vertical port 160. Some of the interior structure of the OMT 100 is visible through a vertical branch waveguide 150. The interior structure will be described in greater detail subsequently. The threaded holes 165 may be configured to allow a standard waveguide component to be coupled to the vertical port 160. For example, in the case of the exemplary C-band OMT, the threaded holes 165 may be compatible with a standard WR-229 waveguide flange.

FIG. 2C is a front view of the OMT 100 normal to the surface containing the common port 120. Some of the interior structure of the OMT 100 is visible through the cylindrical common waveguide 110. The interior structure will be described in greater detail subsequently. FIG. 2D is a side view of the OMT 100.

Figure 3:
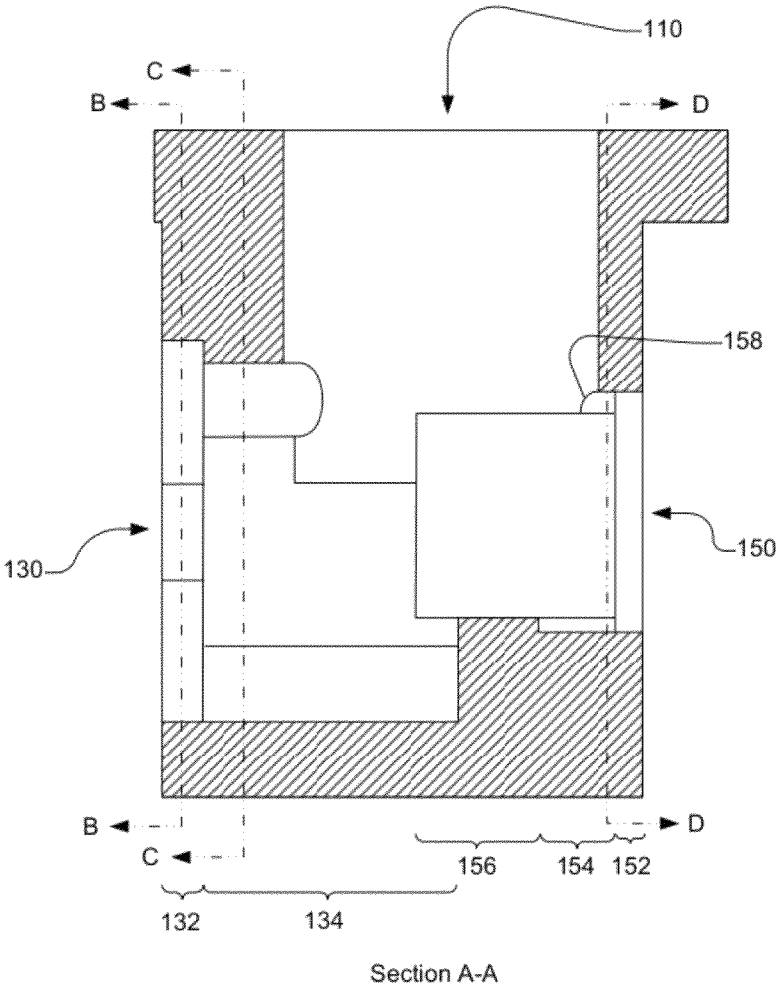
FIG. 3 is a cross-sectional view of the OMT at section plane A-A as defined in FIG. 2A.

FIG. 3 is a cross-sectional view of the OMT 100 at a section plane A-A defined in FIG. 2A. The section plane A-A may contain the axis of the cylindrical common waveguide 110, the horizontal branch waveguide 130 and the vertical branch waveguide 150.

The horizontal branch waveguide 130 may include a first segment 132 and a second segment 134. The first segment 132 and the second segment 134 may be configured to couple a first $TE_{11}$ mode from the horizontal branch waveguide 130 to the cylindrical common waveguide 110. The first segment 132 and the second segment 134 may be ridged waveguides. Dividing a horizontal branch waveguide into two segments is exemplary. A branch waveguide within an OMT may have more or fewer than two segments. At least one of the segments may be a ridged waveguide.

Figure 4C:
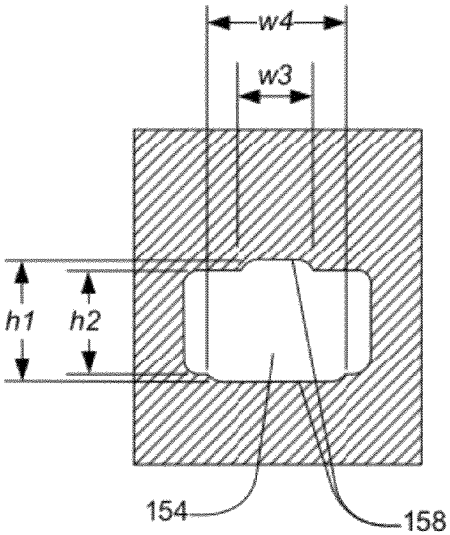
FIG. 4C is a cross-sectional view of the OMT at section plane D-D as defined in FIG. 3.
Figure 4B:
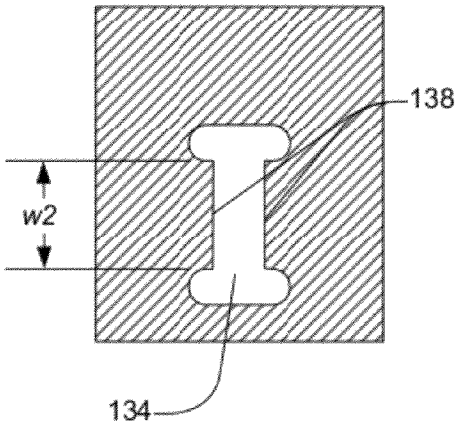
FIG. 4B is a cross-sectional view of the OMT at section plane C-C as defined in FIG. 3.
Figure 4A:
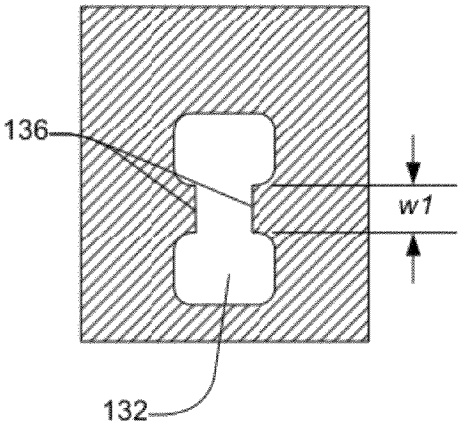
FIG. 4A is a cross-sectional view of the OMT at section plane B-B as defined in FIG. 3.

FIG. 4A shows a cross section of the first segment 132 of the horizontal branch waveguide 130 at a plane B-B defined in FIG. 3. The first segment 132 may be a ridged waveguide, which is to say that the first segment may have a generally rectangular cross section with opposed ridges 136 extending from the long walls of the rectangle. In this context, the term "generally rectangular" includes rectangular waveguides with rounded corners for ease of manufacture. FIG. 4B shows a cross section of the second segment 134 of the horizontal branch waveguide 130 at a plane C-C defined in FIG. 3. The second segment 134 may also have a generally rectangular cross section with opposed ridges 138 extending from the long walls of the rectangle. A width w2 of the ridges 138 of the second segment 134 may be greater than a width w1 of the ridges 136 of the first segment 132.

Referring back to FIG. 3, the vertical branch waveguide 150 may include a first vertical waveguide segment 152, a second vertical waveguide segment 154, and a third vertical waveguide segment 156. The first vertical waveguide segment 152, the second vertical waveguide segment 154, and the third vertical waveguide segment 156 may be configured to couple a second $TE_{11}$ mode, orthogonal to the first $TE_{11}$ mode, from the vertical port 160 to the cylindrical common waveguide 110. Dividing a vertical branch waveguide into three segments is exemplary. A vertical branch waveguide within an OMT may have more or fewer than three segments.

The first vertical waveguide segment 152 and the third vertical waveguide segment 156 of the vertical branch waveguide 150 may have generally rectangular cross-sections. A cross sectional area of the third vertical waveguide segment 156 may be smaller than a cross-sectional area of the first vertical waveguide segment 152. The second vertical waveguide segment 154 may provide a transition between the first vertical waveguide segment 152 and the smaller area of the third vertical waveguide segment 156. The first vertical waveguide segment 152, the second vertical waveguide segment 154, and the third vertical waveguide segment 156 may, in combination, provide impedance matching from a standard rectangular waveguide (see 164 in FIG. 5 and FIG. 6) to the cylindrical common waveguide 110.

FIG. 4C shows a cross section of the second vertical waveguide segment 154 at a plane D-D defined in FIG. 3. The second vertical waveguide segment 154 may have a generally rectangular cross section with recesses 158 formed in the two long walls of the second vertical waveguide segment 154. The recesses 158 may step between a height h1 of the first vertical waveguide segment 152 and a height h2 of the third vertical waveguide segment 156. The two recesses 158 may have the same or different widths w3, w4.

The cross-sectional shapes of the first, second, and third vertical waveguide segments 152, 154, 156 are exemplary and specific to the embodiment shown in the figures. Other embodiments of the OMT may include a vertical branch waveguide including one or more ridged waveguide segments.

Figure 5:
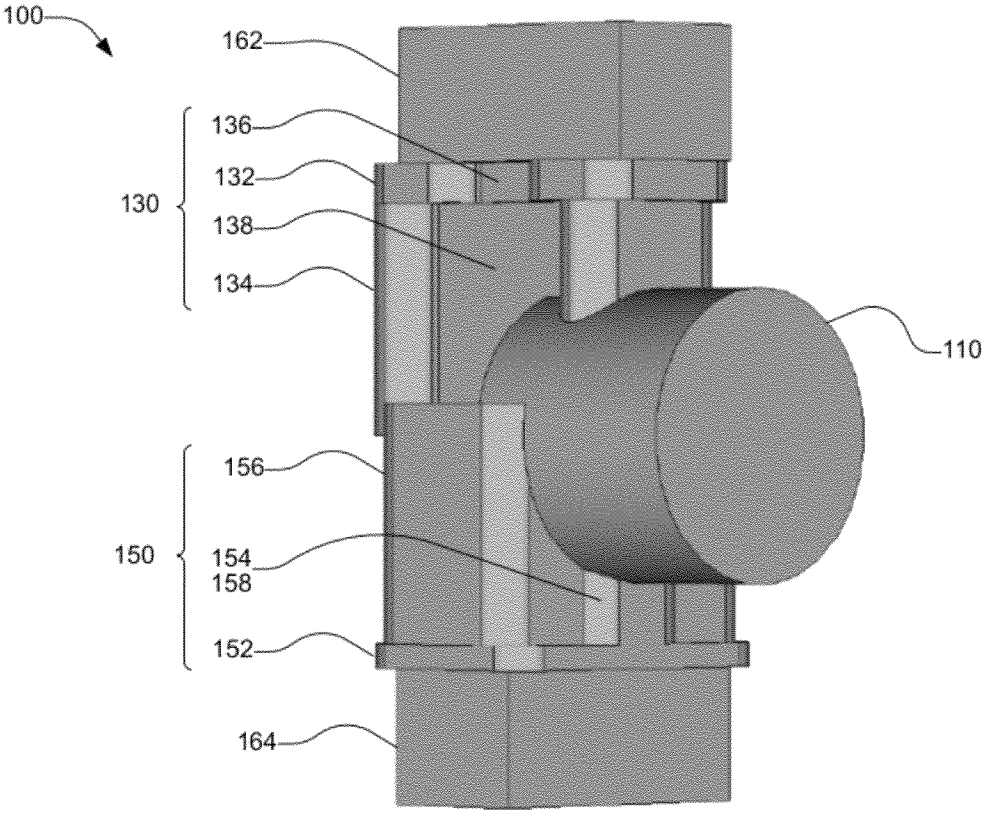
FIG. 5 is a perspective view showing waveguides within an OMT.
Figure 6:
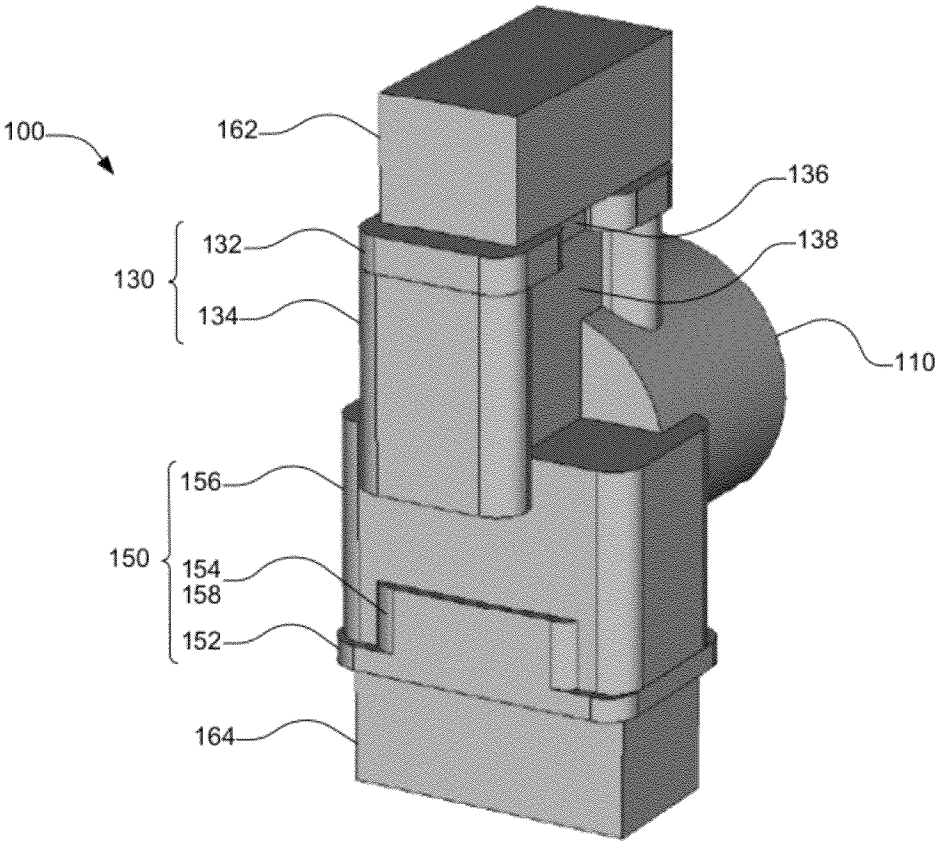
FIG. 6 is a perspective view showing waveguides within an OMT.

The internal structure of the OMT may be understood through consideration of FIG. 5 and FIG. 6, which show different perspective views of the waveguide cavities (with the waveguide body removed) within the OMT 100. FIG. 5 and FIG. 6 represent the airspace or open space within the OMT 100 as a solid body. Elements visible in FIG. 5 and FIG. 6 include the cylindrical common waveguide 110; the horizontal branch waveguide 130 including the first segment 132 with ridges 136 and the second segment with ridges 138; and the vertical branch waveguide 150 including the first vertical waveguide segment 152, the second vertical waveguide segment 154 with recesses 158, and the third vertical waveguide segment 156. Also shown in FIG. 5 and FIG. 6 are conventional rectangular waveguide components 162 and 164 coupled to the horizontal port and the vertical port respectively. The waveguide components 162, 164 are not part of the OMT 100.

An OMT, such as the OMT 100, may be designed such that the segments of the common waveguide and the vertical and horizontal branch waveguides having the largest cross-sectional areas are adjacent to the corresponding common, vertical or horizontal port. Additionally, an OMT may be designed such that the cross-sectional area of each succeeding waveguide segment is smaller than, and contained within, the cross-sectional area of the preceding waveguide segment. "Contained within" means that the entire perimeter of each succeeding waveguide section is visible through the aperture formed by the preceding waveguide section. With such a design, each waveguide section may be formed by machining through the aperture of the preceding waveguide section. Thus each waveguide section may be formed by a numerically controlled machining operation with an end mill or other machine tool, and the number of machining operation steps may be equal to the total number of waveguide segments.

The OMT 100 and other OMT devices designed according to the same principles may be formed in a series of machining operations without assembly or joining operations such as soldering, brazing, bonding, or welding. An OMT designed according to these principles may be formed from a single piece of material. The single piece may be initially a solid block of material. The OMT may be formed from a solid block of a conductive metal material such as aluminum or copper. The OMT may be also formed from a solid block of dielectric material, such as a plastic, which would then be coated with a conductive material, such as a film of a metal such as aluminum or copper, after the machining operations were completed. If justified by the production quantity, a blank approximating the shape of the OMT could be formed prior the machining operations. The blank could be either metal or dielectric material and could be formed by a process such as casting or injection molding.

An OMT, such as the OMT 100, may be designed using a commercial software package such as CST Microwave Studio. An initial model of the OMT may be generated with estimated dimensions for the common waveguide, horizontal branch waveguide, and vertical branch waveguide. The structure may then be analyzed, and the reflection coefficients and cross coupling may be determined for two orthogonal linearly polarized modes introduced respectively at the two branch ports. The dimensions of the model may then be iterated manually or automatically to minimize the reflection coefficients across an operating frequency band.

Figure 7:
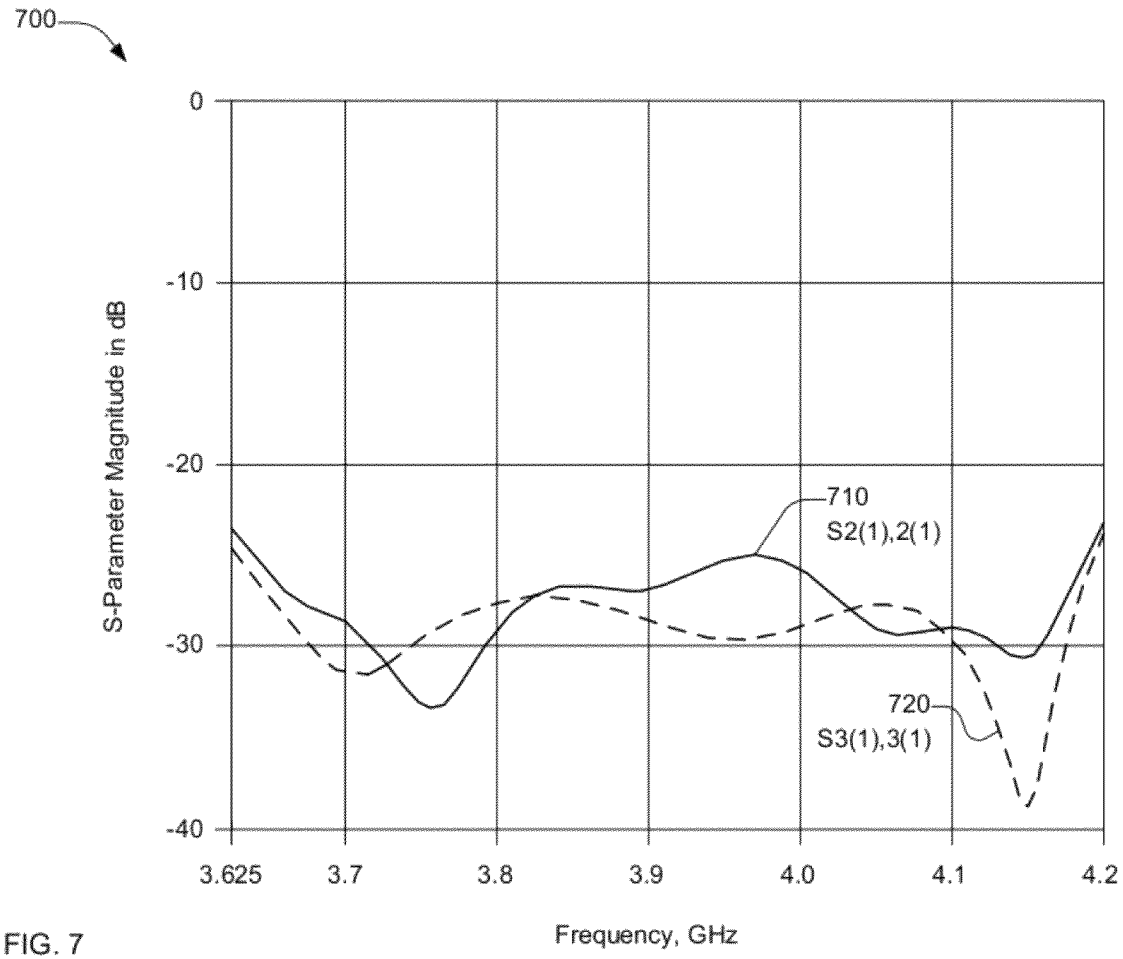
FIG. 7 is a graph showing the simulated performance of an OMT.

FIG. 7 shows a graph illustrating the simulated performance of an exemplary OMT similar to the OMT 100 as shown in FIGS. 1-6. The exemplary OMT was designed for a specific application in a C-band communications terminal operating over a bandwidth of 3.625 GHz to 4.2 GHz. The performance of the exemplary OMT was simulated using finite integral time domain analysis. The time-domain simulation results were Fourier transformed into frequency-domain data as shown in FIG. 7.

The solid line 710 is a graph of the return S2(1),2(1) at the receive port (horizontal port) of the OMT, and the dashed line 720 is a graph of the return S3(1),3(1) at the transmit port (vertical port) of the OMT. The returns S2(1),2(1) and S3(1),3(1) are less than −24 dB over the operating bandwidth of the OMT.

Figure 8:
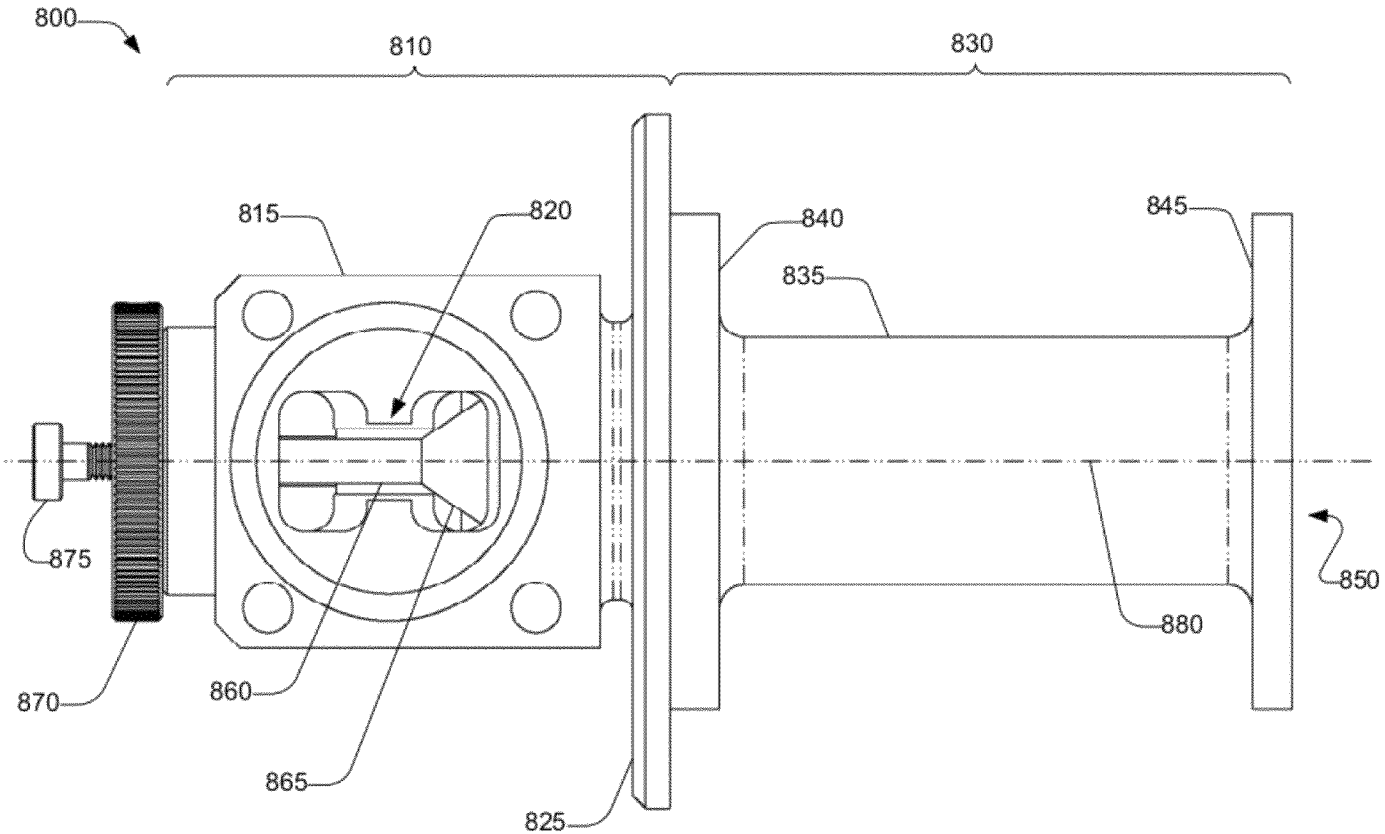
FIG. 8 is a side view of a feed network including an OMT having a ridged branch waveguide.

Referring now to FIG. 8, an exemplary feed network 800, which may be a feed network for a satellite communications system, may include an OMT 810 coupled to a cylindrical waveguide device 830. The cylindrical waveguide device 830 may include a cylindrical tube 835. The cylindrical tube 835 may enclose a cylindrical waveguide (not visible) centered on axis 880. A first flange 840 and a second flange 845 may be disposed at the ends of the cylindrical tube 835 to facilitate attaching the cylindrical waveguide device 830 to adjacent waveguide components. An opening at the end of the cylindrical tube 835 proximate to the second flange 845 may define a common port 850 of the feed network.

With the exception of the shape of a flange 825 that joins the OMT 810 to the cylindrical waveguide device 830, the OMT 810 may be similar to the OMT shown in FIGS. 1-4. The OMT 810 may be formed as a series of machined cavities within an OMT body 815. The machined cavities may form two branch waveguides coupled to two branch ports. The OMT 810 may include a horizontal branch waveguide 820 for coupling a first $TE_{11}$ mode into or from the cylindrical waveguide device 830. The horizontal branch waveguide may be a ridged waveguide as previously described.

The OMT 810 may include a vertical port, not visible in FIG. 8, for coupling a second $TE_{11}$ mode into or from the cylindrical waveguide device 830. A polarization direction of the second $TE_{11}$ mode may be orthogonal to a polarization direction of the first $TE_{11}$ mode.

A common waveguide (not shown) within the OMT 810 may have a shape other than cylindrical. In this case, the OMT may include a converter between its internal common waveguide and the cylindrical waveguide device 830.

The flange 825 of OMT 810 may be coupled to the flange 840 of the cylindrical waveguide device 830 using bolts, rivets, or other fasteners (not shown). The flanges 825, 840, and 845 are representative of typical feed network structures. However, the OMT 810 and the cylindrical waveguide device 830 may be fabricated as a single piece, or may be coupled by soldering, bonding, welding, or other method not requiring the use of the flanges 825, 840, and 845 and/or fasteners.

A rotatable polarizer element may be disposed within the OMT 810 and the cylindrical waveguide device 830. The rotatable polarizer element may be a hollow tube polarizer as described in U.S. Pat. No, 7,772,940. The rotatable polarizer element may be a filter-polarizer element as described in copending patent application Ser. No. 13/045,808. The term "filter-polarizer" is used to describe this element because it functions both as a phase shifting element to change the polarization state of signals propagating in the cylindrical waveguide, and as a filter to inhibit propagation of one or more undesired modes. The only portions of the rotatable polarizer element visible in FIG. 8 are a cylindrical stem 860 and a conical portion 865 that can be seen through the horizontal branch waveguide 820. The rotatable polarizer element may extend through the OMT 810 and the cylindrical waveguide device 830. The cylindrical stem 860 of the rotatable polarizer element may be coupled to an adjustment knob 870 disposed outside of the OMT 810. The adjustment knob 870 and the rotatable polarizer element may be adapted to be rotatable about the axis 880 of the cylindrical waveguide. A locking mechanism, such as a lock screw 875, may be provided to prevent inadvertent movement of the adjustment knob.

Closing Comments

Throughout this description, the embodiments and examples shown should be considered as exemplars, rather than limitations on the apparatus and procedures disclosed or claimed. Although many of the examples presented herein involve specific combinations of apparatus elements, it should be understood that those acts and those elements may be combined in other ways to accomplish the same objectives. Elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of "and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. An ortho-mode transducer comprising:

a common waveguide terminating in a common port;

a horizontal branch waveguide terminating in a horizontal port, the horizontal branch waveguide configured to couple a first linearly polarized mode from the horizontal port to the common waveguide, the horizontal branch waveguide comprising:

a first ridged waveguide segment terminating in the horizontal port, and a second ridged waveguide segment coupling the first ridged waveguide segment to the common waveguide; and a vertical branch waveguide terminating in a vertical port opposed to the horizontal port, the vertical branch waveguide configured to couple a second linearly polarized mode from the vertical port to the common waveguide, the second linearly polarized mode orthogonal to the first linearly polarized mode.

2. The ortho-mode transducer of claim 1, wherein a width of ridges in the second ridged waveguide segment is larger than a width of ridges within the first ridged waveguide segment.

3. The ortho-mode transducer of claim 2, wherein the horizontal branch waveguide consists of the first ridged waveguide segment and the second ridged waveguide segment.

4. The ortho-mode transducer of claim 1, wherein the vertical branch waveguide comprises a plurality of vertical waveguide segments, each of the vertical waveguide segments having a cross sectional shape different from each other of the plurality of vertical waveguide segments, the vertical waveguide segment having the largest cross-sectional shape is adjacent to the vertical port aperture, and each one of the successive vertical waveguide segments has a cross-sectional shape smaller than, and contained within, the cross-sectional shape of the preceding vertical waveguide segment.

5. The ortho-mode transducer of claim 1, wherein the vertical branch waveguide consists of first, second, and third vertical waveguide segments, the first vertical waveguide segment having a generally rectangular shape, the first vertical waveguide segment terminating at the vertical port aperture, the third vertical waveguide segment having a generally rectangular shape with a smaller cross-sectional area than the first vertical waveguide segment, the third vertical waveguide segment disposed to intersect the common waveguide, and the second vertical waveguide segment configured to couple the second linearly polarized mode from the first vertical waveguide segment to the third vertical waveguide segment.

6. The ortho-mode transducer of claim 1, wherein the common waveguide is a right circular cylindrical waveguide.

7. A feed network comprising:

an ortho-mode transducer comprising:

a common waveguide terminating in a common port;

a horizontal branch waveguide terminating in a horizontal port, the horizontal branch waveguide configured to couple a first linearly polarized mode from the horizontal port to the common waveguide, the horizontal branch waveguide comprising:

a first ridged waveguide segment terminating in the horizontal port, and a second ridged waveguide segment coupling the first ridged waveguide segment to the common waveguide; and a vertical branch waveguide terminating in a vertical port opposed to the horizontal port, the vertical branch waveguide configured to couple a second linearly polarized mode from the vertical port to the common waveguide, the second linearly polarized mode orthogonal to the first linearly polarized mode;

a cylindrical waveguide coupled to the common port of the ortho-mode transducer; and a rotatable polarizer element disposed within the cylindrical waveguide.

8. The feed network of claim 7, wherein the rotatable polarizer element comprises an adjustment stem extending through the ortho-mode transducer.

9. The feed network of claim 8, wherein the adjustment stem is coupled to an adjustment knob external to the ortho-mode transducer.

10. The feed network of claim 7, wherein the rotatable polarizer element is a hollow tube polarizer.

11. The feed network of claim 7, wherein the rotatable polarizer element is a filter-polarizer.

12. An ortho-mode transducer comprising:

a common waveguide terminating in a common port;

a horizontal branch waveguide terminating in a horizontal port, the horizontal branch waveguide configured to couple a first linearly polarized mode from the horizontal port to the common waveguide, the horizontal branch waveguide comprising one or more ridged waveguide segments; and a vertical branch waveguide terminating in a vertical port opposed to the horizontal port, the vertical branch waveguide configured to couple a second linearly polarized mode from the vertical port to the common waveguide, the second linearly polarized mode orthogonal to the first linearly polarized mode, the vertical branch waveguide comprising a plurality of vertical waveguide segments, wherein each of the vertical waveguide segments has a cross sectional shape different from each other of the plurality of vertical waveguide segments, the vertical waveguide segment having the largest cross-sectional shape is adjacent to the vertical port aperture, and each one of the successive vertical waveguide segments has cross-sectional shape smaller than, and contained within, the cross-sectional shape of the preceding vertical waveguide segment.

13. The ortho-mode transducer of claim 12, wherein the plurality of vertical waveguide segments consists of first, second, and third vertical waveguide segments, the first vertical waveguide segment having a generally rectangular shape, the first vertical waveguide segment terminating at the vertical port aperture, the third vertical waveguide segment having a generally rectangular shape with a smaller cross-sectional area than the first vertical waveguide segment, the third vertical waveguide segment disposed to intersect the common waveguide, and the second vertical waveguide segment configured to couple the second linearly polarized mode from the first vertical waveguide segment to the third vertical waveguide segment.

14. The ortho-mode transducer of claim 12, wherein the common waveguide is a right circular cylindrical waveguide.

15. A feed network comprising:

an ortho-mode transducer comprising:

a common waveguide terminating in a common port;

a horizontal branch waveguide terminating in a horizontal port, the horizontal branch waveguide configured to couple a first linearly polarized mode from the horizontal port to the common waveguide, the horizontal branch waveguide comprising one or more ridged waveguide segments; and a vertical branch waveguide terminating in a vertical port opposed to the horizontal port, the vertical branch waveguide configured to couple a second linearly polarized mode from the vertical port to the common waveguide, the second linearly polarized mode orthogonal to the first linearly polarized mode, the vertical branch waveguide comprising a plurality of vertical waveguide segments, wherein each of the vertical waveguide segments has a cross sectional shape different from each other of the plurality of vertical waveguide segments, the vertical waveguide segment having the largest cross-sectional shape is adjacent to the vertical port aperture, and each one of the successive vertical waveguide segments has cross-sectional shape smaller than, and contained within, the cross-sectional shape of the preceding vertical waveguide segment;

a cylindrical waveguide coupled to the common port of the ortho-mode transducer; and a rotatable polarizer element disposed within the cylindrical waveguide.

16. The feed network of claim 15, wherein the rotatable polarizer element comprises an adjustment stem extending through the ortho-mode transducer.

17. The feed network of claim 16, wherein the adjustment stem is coupled to an adjustment knob external to the ortho-mode transducer.

18. The feed network of claim 15, wherein the rotatable polarizer element is a hollow tube polarizer.

19. The feed network of claim 15, wherein the rotatable polarizer element is a filter-polarizer.

* * * * *